US007083459B1

(12) United States Patent
Wu et al.

(10) Patent No.: US 7,083,459 B1
(45) Date of Patent: Aug. 1, 2006

(54) LATCHING CONNECTOR ASSEMBLY

(75) Inventors: Xuemei Wu, Fremont, CA (US); Peixuan Hu, DongGuan (CN)

(73) Assignee: BizLink Technology, Inc., Fremont, CA (US)

( * ) Notice: Subject to any disclaimer, the term of this patent is extended or adjusted under 35 U.S.C. 154(b) by 0 days.

(21) Appl. No.: 11/111,179

(22) Filed: Apr. 20, 2005

(51) Int. Cl.
*H01R 13/62* (2006.01)

(52) U.S. Cl. ..... 439/354; 439/358

(58) Field of Classification Search ..... 439/353, 439/354, 357, 358
See application file for complete search history.

(56) References Cited

U.S. PATENT DOCUMENTS

| | | | | |
|---|---|---|---|---|
| 3,933,406 | A | 1/1976 | Cameron et al. | |
| 4,621,885 | A * | 11/1986 | Szczesny et al. | 439/357 |
| 4,778,411 | A * | 10/1988 | Rudy et al. | 439/681 |
| 5,230,636 | A | 7/1993 | Masuda et al. | |
| 5,334,041 | A * | 8/1994 | Anbo et al. | 439/358 |
| 5,340,329 | A * | 8/1994 | Hirai | 439/357 |
| 6,146,205 | A * | 11/2000 | Lai | 439/610 |
| 6,217,365 | B1 | 4/2001 | Shinozaki | |
| 6,325,656 | B1 | 12/2001 | Fukuda et al. | |
| 6,341,975 | B1 | 1/2002 | Takatsuki et al. | |
| 6,343,948 | B1 | 2/2002 | Nutzel | |
| 6,485,315 | B1 | 11/2002 | Hwang | |
| 6,565,383 | B1 * | 5/2003 | Wu | 439/567 |
| 6,585,537 | B1 * | 7/2003 | Lee | 439/358 |
| 6,592,392 | B1 | 7/2003 | Po-Heng | |
| 6,655,979 | B1 * | 12/2003 | Lee | 439/357 |
| 6,736,663 | B1 | 5/2004 | Lee et al. | |
| 6,799,986 | B1 | 10/2004 | Igarashi et al. | |
| 6,821,139 | B1 | 11/2004 | Wu | |
| 6,830,472 | B1 * | 12/2004 | Wu | 439/358 |
| 6,835,087 | B1 | 12/2004 | Yamawaki | |
| 6,848,932 | B1 | 2/2005 | Bowling et al. | |
| 6,860,750 | B1 | 3/2005 | Wu | |
| 6,890,205 | B1 * | 5/2005 | Wu | 439/358 |
| 6,951,474 | B1 * | 10/2005 | Wu | 439/358 |
| 2005/0101176 | A1 | 5/2005 | Kachlic | |

OTHER PUBLICATIONS

ROOS, Gina, "Serial AYA comes on strong in 2004," EE Product Center, www.eeproductcenter.com, CMP Media LLC, Manhasset, New York, article dated Jun. 28, 2004.
WU, Xuemei, Declaration and associated Exhibit A (6 sheets of photographs).

* cited by examiner

*Primary Examiner*—Gary F. Paumen
(74) *Attorney, Agent, or Firm*—Law Office of Andrei D. Popovici, P.C.

(57) ABSTRACT

In some embodiments, an electrical cable connector includes a latching spring having a user-pressable top plate coupled to a fixed base through a frontal U-shaped hinge. The top plate includes bi-directionally (front and back) sloped latching protrusions which fit into matching openings defined in a complementary connector. A connector pair can be separated by pressing the top plate to lower the latching protrusions, and/or by applying a pulling force lower than a cable-damaging threshold to cause the connectors to self-release. The hinge structure can include a pair of laterally-spaced hinges separated by a central notch. The width of the central notch can be chosen to yield desired spring properties.

20 Claims, 4 Drawing Sheets

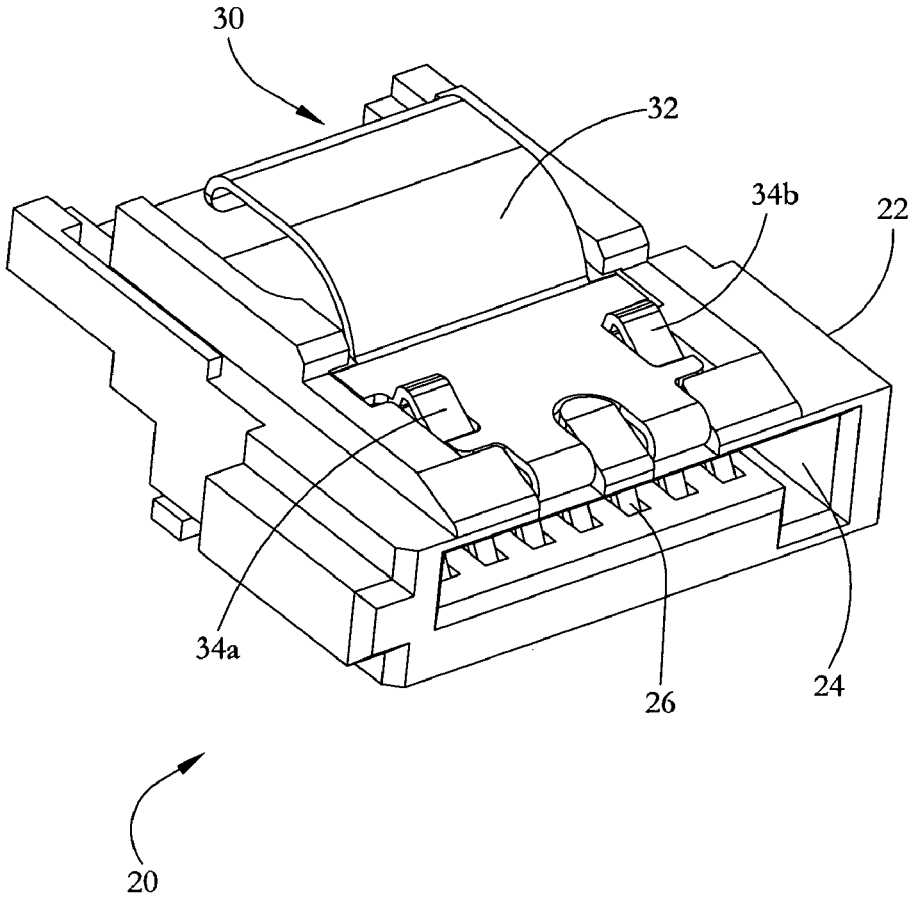
FIG. 1-A

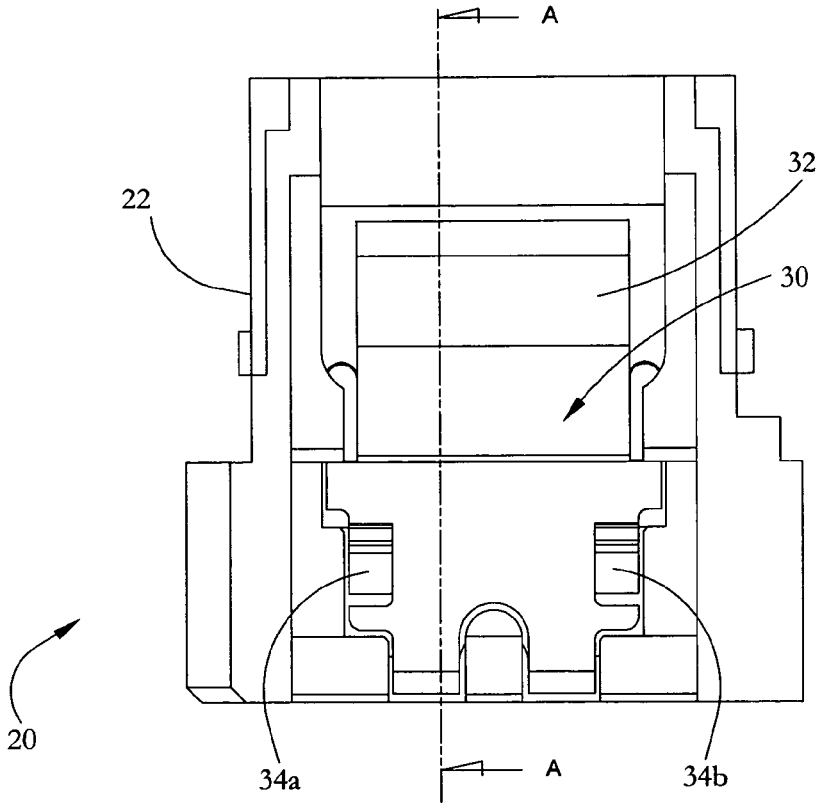
FIG. 1-B
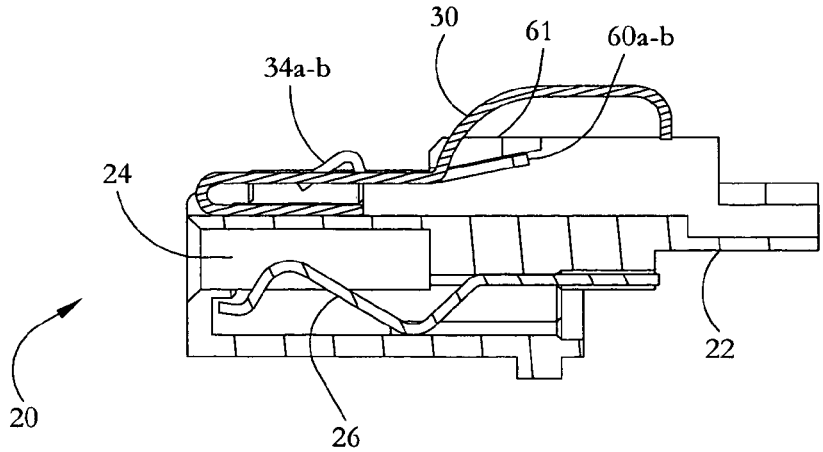
FIG. 1-C

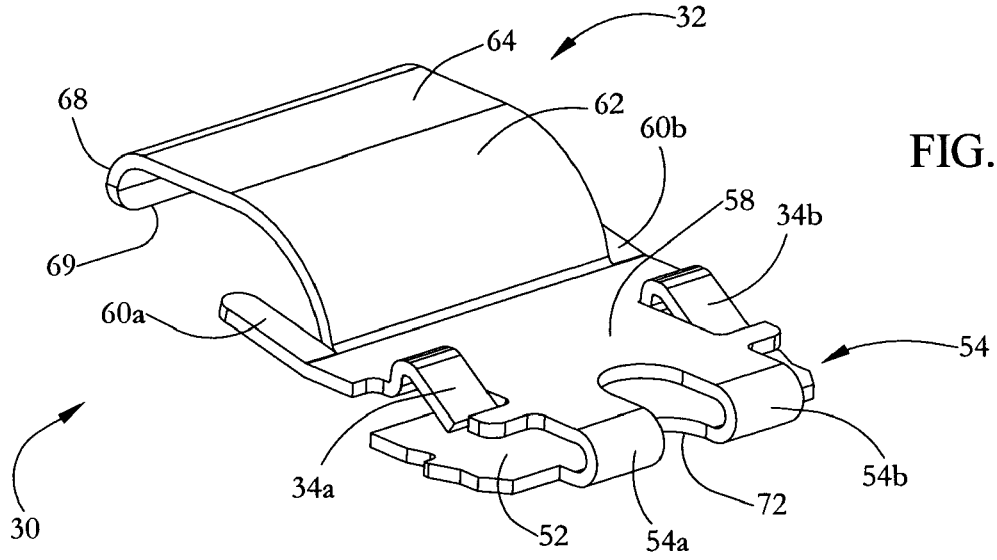
FIG. 3-A
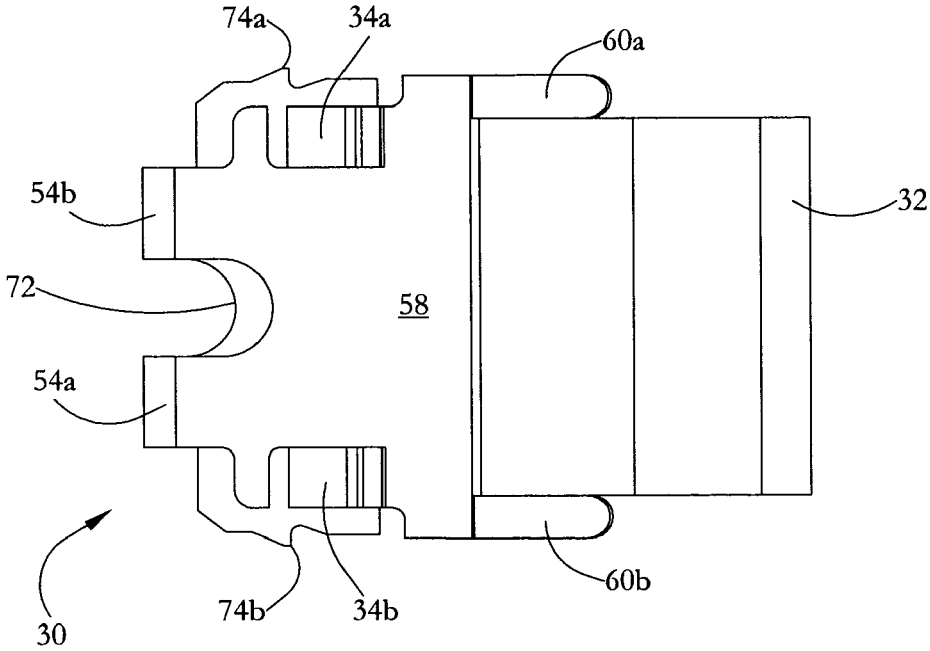
FIG. 3-B
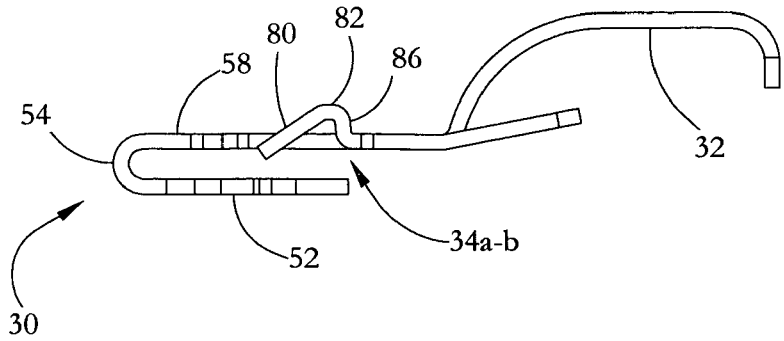
FIG. 3-C

LATCHING CONNECTOR ASSEMBLY

BACKGROUND

The invention relates to electrical cable connector assemblies, and in particular to latching cable connector assemblies.

Electrical cable connectors are used in a variety of applications, including for interconnecting computer components. As an example, electrical cable connectors include Serial Advanced Technology Attachment (Serial ATA, or SATA) connectors, which are used to connect computer peripherals such as hard disk drives. Various other data cables and/or power cables can be used within computers.

In U.S. Pat. No. 6,860,750, Wu describes a cable end connector assembly for mating with a complementary connector, including an insulative housing, a number of contacts received in the insulative housing, a spacer mounted to a rear end of the insulative housing, a cable including a number of conductors electrically connecting with corresponding contacts, a cover over-molded with the insulative housing and the cable, and a locking member. The housing forms a pair of wing portions extending rearwardly therefrom. The cover defines a pair of passages to receive the wing portions. The locking member includes a retaining section secured with the insulative housing, a pushing section engaged with the pair of wing portions, and a pair of latch portions located close to the retaining section.

Some prior art designs, such as the one described by Wu, can exhibit limited reliability, and can be damaged by application of excessive external forces.

SUMMARY

According to one aspect, a latching, self-releasing electrical cable end connector assembly includes a first connector housing coupled to a first set of electrical connectors, a latching spring mounted on the first housing, and a second connector housing coupled to a second set of electrical connectors. The latching spring comprises a base mounted on the housing, a U-shaped hinge structure extending upward from a frontal side of the base, a top movable plate situated generally above the base and flexibly coupled to the base through the hinge structure, and a release tab coupled to a back side of the top plate and extending generally rearwardly from the top plate. The top plate has a pair of laterally-spaced latching upward protrusions. Each latching protrusion has a front sloped surface facilitating an insertion of the latching spring into a latched position, and a back sloped surface facilitating a self-release of the latching spring from the latched position in response to a rearward pulling force. Pressing down the release tab lowers the latching protrusions to facilitate a release of the latching spring from the latched position. The second connector housing comprises a pair of latching depressions sized to receive the latching protrusions in the latched position. The second set of electrical connectors are electrically connected to the first set of electrical connectors when the latching spring is in the latched position.

According to another aspect, a cable connector latching spring includes a base, a U-shaped hinge structure extending upward from a frontal side of the base, a top movable plate situated generally above the base and flexibly coupled to the base through the hinge structure, and a release tab coupled to a back side of the top plate and extending generally rearwardly from the top plate. The top plate has at least one latching upward protrusions. The at least one latching protrusion has a front sloped surface facilitating an insertion of the latching spring into a latched position, and a back sloped surface facilitating a self-release of the latching spring from the latched position in response to a rearward pulling force. Pressing down the release tab lowers the at least one latching protrusion to facilitate a release of the latching spring from the latched position.

According to another aspect, a cable connector latching spring comprises a base, a U-shaped hinge structure extending upward from a frontal side of the base, a top movable plate situated generally above the base and flexibly coupled to the base through the hinge structure, and a release tab coupled to a back side of the top plate and extending generally rearwardly from the top plate. The U-shaped hinge structure comprising a pair of laterally-spaced U-shaped hinges separated by a central notch. The top plate has a pair of latching upward protrusions, each latching protrusion having a front sloped surface facilitating an insertion of the latching spring into a latched position. The release tab comprises a front, upward sloping section connected to the top plate, and a rear downward sloping section having a free rear end. Pressing down the release tab lowers the set of latching protrusions to facilitate a release of the latching spring from the latched position.

According to another aspect, a cable connection method includes sliding a pair of latching protrusions of a latching spring coupled to a first electrical connector into matching depressions formed in a second electrical connector to couple the first connector to the second connector in a latched position. Each of the latching protrusions has a front sloped surface facilitating an insertion of the latching spring into the latched position, and a back sloped surface facilitating a self-release of the latching spring from the latched position in response to a rearward pulling force. The method further includes disconnecting the first connector and the second connector alternatively by pulling the first connector and the second connector apart by depressing a release tab to lower the pair of latching protrusions out of the matching depressions, and pulling the first connector and the second connector apart without depressing the release tab to self-release the latching spring from the latched position. Depressing the release tab causes a flexure of a U-shaped hinge structure connecting the release tab and latching protrusions to a latching spring base mounted on a housing of the first connector.

BRIEF DESCRIPTION OF THE DRAWINGS

The foregoing aspects and advantages of the present invention will become better understood upon reading the following detailed description and upon reference to the drawings where:

FIG. 1-A shows an isometric view of a connector according to some embodiments of the present invention.

FIG. 1-B shows a top view of the connector of FIG. 1-A according to some embodiments of the present invention.

FIG. 1-C shows a side sectional view of the connector of FIGS. 1-A–B, along a section A—A shown in FIG. 1-B, according to some embodiments of the present invention.

FIG. 3-A shows an isometric view of a latching spring of the connector of FIG. 1-A, according to some embodiments of the present invention.

FIG. 3-B shows a top view of the latching spring of FIG. 3-A according to some embodiments of the present invention.

FIG. 3-C shows a side view of the latching spring of FIG. 3-A according to some embodiments of the present invention.

DETAILED DESCRIPTION OF PREFERRED EMBODIMENTS

Figure 2:
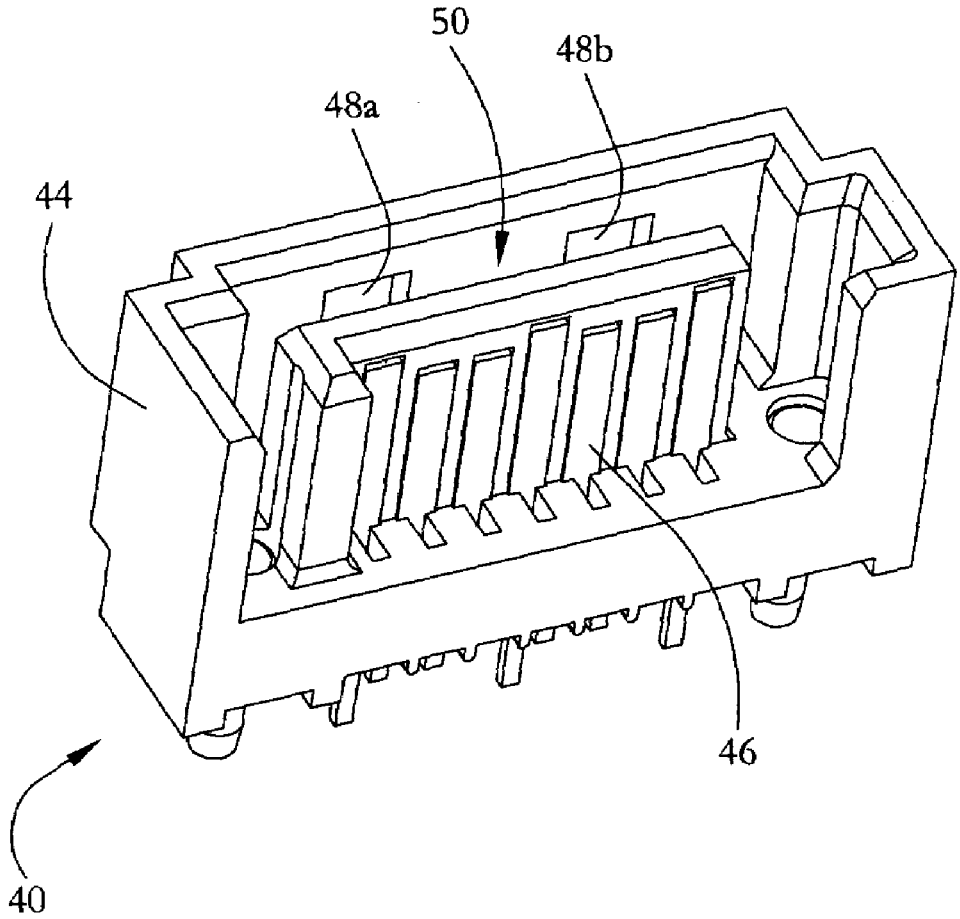
FIG. 2 shows an isometric view of a connector shaped to mate the connector of FIG. 1-A according to some embodiments of the present invention.

In the following description, it is understood that any recitation of an element refers to at least one element. A set of elements includes one or more elements. A plurality of elements includes two or more elements. Each recited element/structure can be formed by or be part of a monolithic structure, or be formed from multiple distinct structures. A recitation of two distinct elements does not exclude the two elements forming different parts of a single monolithic structure. Directions such as upward and downward are relative directions, and not necessarily defined with respect to the direction of gravity. A sloped surface may have linearly sloped and/or curved sloped portions.

FIG. 1-A shows an isometric view of a connector 20 according to some embodiments of the present invention. FIG. 1-B shows a top view of connector 20, while FIG. 1-C shows a side view of connector 20. Connector 20 includes an insulative housing 22, and a latching spring 30 mounted on housing 22. Housing 22 includes a frontal connection aperture 24 allowing access to a plurality of electrical contacts 26. Latching spring 30 is mounted along a top side of housing 22. Latching spring 30 includes a press/release tab 32 extending above housing 22, as well as two laterally-spaced latching protrusions 34*a–b* situated along the top side of latching spring 30. When a user presses down release tab 32, protrusions 34*a–b* are lowered and connector 20 is released from its mating connector, as described below.

FIG. 2 shows an isometric view of a connector 40 shaped to mate the connector 20 of FIG. 1-A, according to some embodiments of the present invention. Connector 40 includes an insulative housing 44 covering a plurality of electrical contacts 46. Electrical contacts 46 touch the contacts 26 of connector 20 (FIG. 1-A) when connector 40 is coupled to connector 20 in a latched position. Two laterally-spaced latching depressions 48*a–b* are formed on the bottom side of a top cover of housing 44. Latching depressions 48*a–b* are shaped to engage the latching protrusions 34*a–b* of latching spring 30 (FIGS. 1-A–C). In the illustrated embodiment, latching depressions 48*a–b* have a rectangular lateral profile. A frontal opening 50 receives latching spring 30 in the latching position.

FIG. 3-A shows an isometric view of latching spring 30 according to some embodiments of the present invention. FIGS. 3-B shows a top view of latching spring 30. FIG. 3-C shows a side view of latching spring 30. Latching spring 30 is integrally formed from a single monolithic piece of a flexible metal such as stainless steel. In some embodiments, stainless steel can be used because of its ability to provide both a sufficient retention force, and sufficient flexibility to allow release of the latch upon user pressure. In some embodiments, latching spring 30 can be formed from or include other flexible metals such as copper, bronze, or cold-rolled steel, or non-metallic flexible materials. In some embodiments, the choice of material(s) may depend on particular latching spring dimensions and geometry, auto-release force requirements, retention force requirements, and durability needs.

Latching spring 30 comprises a bottom mounting base plate 52, a hinge structure 54 comprising a pair of curved, U-shaped hinges 54*a–b* extending upward from the front side of base plate 52, and a top plate 58 extending above and parallel to mounting plate 52, backward from hinges 54*a–b*. Release tab 32 extends generally upward and backward from the rear of top plate 58. Release tab 32 includes an upward sloping section 62 extending upward and backward from top plate 58, a top middle section 64 situated behind section 62, and a downward-sloping rear section 68 situated behind middle section 64 and having a free rear end 69. The vertical bulge formed by release tab 32 provides users with easy access to release tab 32, while the backward-sloping geometry of rear section 68 improves the comfort of a user's application of pressure to release tab 32. A flat-edge release tab may be less comfortable to a user's finger.

Hinges 54*a–b* are laterally-spaced with respect to each other, and are separated by a central notch (gap) 72. The width of gap 72 can be used to control the spring constant of latching spring 30. A pair of vertical-movement restriction members 60*a–b* extend rearwardly from the back of top plate 58, along the two lateral sides of release tab 32. Vertical restriction members 60*a–b* fit under a corresponding housing cover structure 61, as shown in FIG. 1-C, to prevent latching spring 30 from lifting away from housing 22. A pair of lateral wings 74*a–b* extends along the sides of base plate 52. Lateral wings 74*a–b* fit in matching depressions defined in housing 22 to secure latching spring 30 to housing 22 in a fixed position.

Each latching protrusion 34*a–b* is sloped bi-directionally, front and back, as shown in FIG. 3-C. A front sloped surface (chamfer) 80 facilitates the insertion of latching spring 30 into a latched position. Back sloped surface 86 facilitates a self-release of latching spring 30 from the latched position in response to a rearward pulling force exerted on latching spring 30 through housing 22. A curved top surface 82 provides a smooth transition between sloped surfaces 80, 86. Back sloped surface 86 is more steeply sloped than front sloped surface 80, so that latching connectors 20, 40 together requires a lower applied force than self-releasing the two connectors in response to a pulling force. The slope of back-sloped surface 86 and the curvature radius of top surface 82 can be used to adjust a self-release force threshold for connectors 20, 40.

As shown in FIG. 3-C, each latching protrusion 34*a–b* is formed by a curved, generally-longitudinal flexible cantilever structure connected to top plate 58 at the rear of the protrusion. The front end of each latching protrusion 34*a–b* is free. The flexible, sloped cantilever allows protrusions 34*a–b* to flex downward in response to a pulling force, and thus facilitate the self-release of latching spring 30.

In some embodiments, latching protrusions 34*a–b* have a height on the order of mm, for example about 1 mm, and a width on the order of mm, for example about 1 mm. The overall width of latching spring 30 can be on the order of 1 cm. The height of hinges 54*a–b* can be on the order of 1 mm, with their radius of curvature equal to about half the height. Release tab 32 can extend upward from top plate 58 by a distance on the order of several mm. The length of bottom base plate 52 can be on the order of several mm.

In some embodiments, the assembly formed by connectors 20, 40 has a latching spring self-release force between about 25 N and 35 N, for example about 30 N. The self-release force is the force needed to self-disconnect connectors 20, 40 when release tab 32 is not depressed. The self-release force is preferably chosen to avoid damage to the connectors or other components as a result of excessive pulling forces. A force of 30 N corresponds to a load of about 6.5 lbs. In some embodiments, the latch retention force for connectors 20, 40 is between 20 N and 30 N, for example about 25 N. The latch retention force is an applied force that, in a repeatable manner, does not cause a self-release of connectors 20, 40. For example, a given latch retention force can be tested over 50 mating cycles to ensure the connectors do not self-release in response to application of the latch-retention force.

Figure 4:
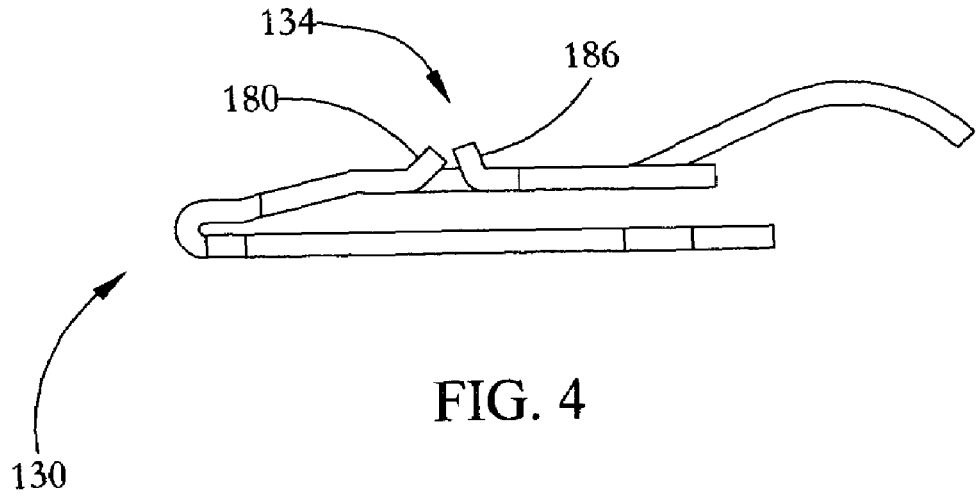
FIG. 4 shows a side view of a latching spring according to some embodiments of the present invention.

FIG. 4 shows a side view of a latching spring 130 according to some embodiments of the present invention. Latching spring 130 includes one or more discontinuous latching protrusions 134, each including a front sloped surface 180 facilitating insertion of latching spring 130 into a latched position, and a back sloped surface 186 facilitating the self-release of latching spring 130 from the latched position in response to an applied pulling force. As illustrated, the front and back surfaces 180, 186 are separated by a gap.

The exemplary U-shaped hinge structures described above allow reliable operation of the latching assembly over many connection cycles, by reducing undesirable material fatigue. The curved surface of the U-shape reduces the maximal localized strain to which the hinge is exposed. The flexing tension is borne mostly by the latching spring itself, rather than transferred to a softer outer housing material such as a thermoplastic. The width of the notch between the two hinges can be chosen to achieve a desired spring constant for the latching spring. The bi-directionally-sloped latching protrusions allow the controlled connection and self-release of the two connectors in response to either a user depressing the release tab, or in response to a sufficient pulling force even when the release tab is not pressed.

It will be clear to one skilled in the art that the above embodiments may be altered in many ways without departing from the scope of the invention. For example, the spring base may include apertures or other discontinuities formed therein, and need not be uniformly planar. The top plate and release tab may form different parts of a continuously-curved surface, and need not have a sharply-defined interface or inflection line. The latching protrusion(s) can be formed by solid materials rather than a cantilever or shell structure. In some embodiments, the latching protrusions need not include a back sloped surface; a back surface can then be vertical, or even acutely-angled with respect to the longitudinal direction. Accordingly, the scope of the invention should be determined by the following claims and their legal equivalents.

What is claimed is:

1. A latching, self-releasing electrical cable connector assembly comprising:

a first connector housing coupled to a first set of electrical connectors;

a latching spring mounted on the first housing, the latching spring comprising a base mounted on the first housing, a U-shaped hinge structure extending upward from a frontal side of the base, a top movable plate situated generally above the base and flexibly coupled to the base through the hinge structure, the top plate having a pair of laterally-spaced latching upward protrusions, each latching protrusion having a front sloped surface facilitating an insertion of the latching spring into a latched position, and a back sloped surface facilitating a self-release of the latching spring from the latched position in response to a rearward pulling force, and a release tab coupled to a back side of the top plate and extending generally rearwardly from the top plate, wherein pressing down the release tab lowers the latching protrusions to facilitate a release of the latching spring from the latched position; and a second connector housing coupled to a second set of electrical connectors, the second connector housing comprising a pair of latching depressions sized to receive the latching protrusions in the latched position, the second set of electrical connectors being electrically connected to the first set of electrical connectors when the latching spring is in the latched position.

2. The assembly of claim 1, wherein the back-sloped surface is more steeply sloped than the front sloped surface.

3. The assembly of claim 1, wherein the U-shaped hinge structure comprises a pair of laterally-spaced U-shaped hinges separated by a central notch.

4. The assembly of claim 1, wherein the latching spring further comprises a pair of laterally-spaced vertical-constraint members extending rearwardly from the back side of the top plate, the vertical-constraint members engaging the first connector housing to constrain an upward motion of the latching spring relative to the first connector housing.

5. The assembly of claim 1, wherein the latching spring further comprises a pair of wings protruding laterally away from the base, the wings facilitating a locking of the latching spring to the first housing.

6. The assembly of claim 1, wherein the latching spring is integrally formed from a single monolithic metal piece.

7. The assembly of claim 1, wherein said each latching protrusion is formed by a generally longitudinal curved cantilever attached at a rear of said each latching protrusion.

8. The assembly of claim 1, wherein the release tab comprises a front, upward sloping section connected to the top plate, and a rear downward sloping section having a free rear end.

9. The assembly of claim 1, wherein the assembly has a latching spring self-release force threshold higher than or equal to about 25 N, and lower than or equal to about 35 N.

10. The assembly of claim 9, wherein the self-release force threshold is about 30 N.

11. The assembly of claim 9, wherein the assembly has a latching spring retention force threshold higher than or equal to about 20 N, and lower than or equal to about 30 N.

12. The assembly of claim 11, wherein the retention force threshold is about 25 N.

13. A cable connector latching spring comprising:

a base;

a U-shaped hinge structure extending upward from a frontal side of the base;

a top movable plate situated generally above the base and flexibly coupled to the base through the hinge structure, the top plate having a set of latching upward protrusions, each latching protrusion having a front sloped surface facilitating an insertion of the latching spring into a latched position, and a back sloped surface facilitating a self-release of the latching spring from the latched position in response to a rearward pulling force; and a release tab coupled to a back side of the top plate and extending generally rearwardly from the top plate, wherein pressing down the release tab lowers the set of latching protrusions to facilitate a release of the latching spring from the latched position.

14. The latching spring of claim 13, wherein the back-sloped surface is more steeply sloped than the front sloped surface.

15. The latching spring of claim 13, wherein the U-shaped hinge structure comprises a pair of laterally-spaced U-shaped hinges separated by a central notch.

16. The latching spring of claim 13, wherein the latching spring further comprises a pair of laterally-spaced vertical-constraint members extending rearwardly from the back side of the top plate, for constraining an upward motion of the latching spring.

17. The latching spring of claim 13, further comprising a pair of wings protruding laterally away from the base, the wings facilitating a locking of the latching spring to a housing.

18. The latching spring of claim 13, wherein said each latching protrusion is formed by a generally longitudinal curved cantilever attached at a rear of said each latching protrusion.

19. A cable connector latching spring comprising:

a base;

a U-shaped hinge structure extending upward from a frontal side of the base, the U-shaped hinge structure comprising a pair of laterally-spaced U-shaped hinges separated by a central notch;

a top movable plate situated generally above the base and flexibly coupled to the base through the hinge structure, the top plate having a pair of latching upward protrusions, each latching protrusion having a front sloped surface facilitating an insertion of the latching spring into a latched position; and a release tab coupled to a back side of the top plate and extending generally rearwardly from the top plate, the release tab comprising a front, upward sloping section connected to the top plate, and a rear downward sloping section having a free rear end, wherein pressing down the release tab lowers the set of latching protrusions to facilitate a release of the latching spring from the latched position.

20. An electrical cable connection method comprising:

sliding a pair of latching protrusions of a latching spring coupled to a first electrical connector into matching depressions formed in a second electrical connector to couple the first connector to the second connector in a latched position, wherein the of the latching protrusions has a front sloped surface facilitating an insertion of the latching spring into the latched position, and a back sloped surface facilitating a self-release of the latching spring from the latched position in response to a rearward pulling force; and disconnecting the first connector and the second connector alternatively by pulling the first connector and the second connector apart by depressing a release tab to lower the pair of latching protrusions out of the matching depressions, wherein depressing the release tab causes a flexure of a U-shaped hinge structure connecting the release tab and latching protrusions to a latching spring base mounted on a housing of the first connector; and pulling the first connector and the second connector apart without depressing the release tab to self-release the latching spring from the latched position.

* * * * *